US005681656A

United States Patent [19]

Inukai et al.

[11] Patent Number: 5,681,656

[45] Date of Patent: Oct. 28, 1997

[54] POLYAMIDE-IMIDE FIBERS FOR A BAG FILTER

[75] Inventors: Chuji Inukai; Tomoharu Kurita; Keiichi Uno, all of Ohtsu, Japan

[73] Assignee: Toyo Boseki Kabushiki Kaisha, Osaka, Japan

[21] Appl. No.: 546,530

[22] Filed: Oct. 20, 1995

[51] Int. Cl.[6] ..... D02G 3/00

[52] U.S. Cl. ..... 428/364; 428/365; 428/394

[58] Field of Search ..... 428/364, 365, 428/394; 528/350, 353, 74, 73

[56] References Cited

U.S. PATENT DOCUMENTS

| | | | |
|---|---|---|---|
| 3,717,696 | 2/1973 | Rochina et al. | 264/205 |
| 3,903,058 | 9/1975 | Allard et al. | 264/184 |
| 3,929,691 | 12/1975 | Allard | 260/30.2 |
| 4,530,975 | 7/1985 | Mukoyama et al. | 428/378 |
| 4,801,502 | 1/1989 | Weinrotter et al. | 428/359 |
| 5,124,428 | 6/1992 | Yokelson et al. | 528/350 |
| 5,159,052 | 10/1992 | Barthelemy et al. | 528/73 |
| 5,187,254 | 2/1993 | Yokelson et al. | 528/73 |
| 5,458,969 | 10/1995 | Yokelson et al. | 428/364 |

FOREIGN PATENT DOCUMENTS

| | | |
|---|---|---|
| 52-17133 | 5/1977 | Japan . |
| 56-014517 | 2/1981 | Japan . |
| 63-27444 | 6/1988 | Japan . |
| 63-210120 | 8/1988 | Japan . |
| 3-131630 | 6/1991 | Japan . |
| 5-222612 | 8/1993 | Japan . |
| 7-310232 | 11/1995 | Japan . |
| 1268267 | 3/1972 | United Kingdom . |
| 1308582 | 2/1973 | United Kingdom . |
| 1 432 285 | 10/1973 | United Kingdom . |
| 1402559 | 8/1975 | United Kingdom . |
| WO 92/21711 | 12/1992 | WIPO . |

*Primary Examiner*—Newton Edwards
*Attorney, Agent, or Firm*—Leydig, Voit & Mayer, Ltd.

[57] ABSTRACT

The present invention provides polyamide-imide fibers for a bag filter comprising a polyamide-imide resin produced by reacting an isocyanate component and an acid anhydride component, the isocyanate component comprising 4,4'-diphenylmethane diisocyanate in an amount of at least 60 mol % of the isocyanate component.

13 Claims, No Drawings

POLYAMIDE-IMIDE FIBERS FOR A BAG FILTER

BACKGROUND OF THE INVENTION

1. Field of the Invention

The present invention relates to polyamide-imide fibers for a bag filter. More specifically, the present invention relates to polyamide-imide fibers for a high-temperature bag filter, which is capable of being easily produced at low cost in general-purpose facilities, which has outstanding heat resistance, flame resistance, and chemical resistance and has high strength and high elasticity, and which is used for exhaust gas facilities.

2. Description of the Related Art

Conventionally, aramid (aromatic amide) fibers have been used as heat-resistant fibers for a bag filter. Examples of the aramid fibers include para-aramid (p-aromatic amid) fibers obtained from terephthaloyl chloride and p-phenylenediamine and meta-aramid (m-aromatic amide) fibers obtained from isophthaloyl chloride and m-phenylenediamine. However, these fibers must be produced by particular methods, which require particular facilities and complicated operation.

On the other hand, polyimide is known as a representative example of heat-resistant polymers. It has been attempted to produce fibers for a bag filter composed of polyimide. For example, it has been proposed to fiberize poly(4,4'-oxydiphenylenepyromellitimido). However, in this case, poly(amic acid) which is an intermediate polymer should be cyclized by dehydration by heat treatment at a high temperature after spinning and drawing. This allows voids to be formed in the fibers after heat treatment which decreases the strength of the fibers as well as increase production costs.

In light of the circumstances described above, there has been a demand for fibers having sufficient specified characteristics (e.g., heat resistance, flame resistance, chemical resistance, high strength, and high elasticity) as heat-resistant fibers for a bag filter, which can be easily produced in general-purpose facilities.

SUMMARY OF THE INVENTION

The polyamide-imide fibers for a bag filter of the present invention mainly include polyamide-imide containing at least one of diaminodiphenylmethane and analogs thereof as an amine component in an amount of at least 60 mol %.

In one embodiment of the present invention, the above-mentioned polyamide-imide fibers for a bag filter further contain o-tolidine as an amine component.

Alternatively, the polyamide-imide fibers for a bag filter of the present invention mainly include a polyamide-imide containing alkylene glycol dianhydrotrimellitate as an acid anhydride component in an amount of 60 mol % or less.

In one embodiment of the present invention, the above-mentioned polyamide-imide fibers for a bag filter further contain at least one selected from the group consisting of benzophenonetetracarboxylic dianhydride, 3,3',4,4'-diphenyltetracarboxylic dianhydride, end pyromellitic dianhydride as the acid anhydride component.

In another embodiment of the present invention, the polyamide-imide is modified with an epoxy compound.

In another embodiment of the present invention, the above-mentioned polyamide-imide fibers for a bag filter have the following fiber physical properties (A) and (B) in an undrawn state or as a result of being drawn and heated:

(A) tensile break strength of at least 3.0 g/d; and (B) tensile break elongation of at least 10%.

Thus, the invention described herein makes possible the advantage of providing polyamide-imide fibers, which is capable of being easily produced at low cost in general-purpose facilities, which has outstanding heat resistance, flame resistance, and chemical resistance and has high strength and high elasticity.

This and other advantages of the present invention will become apparent to those skilled in the art upon reading and understanding the following detailed description.

DESCRIPTION OF THE PREFERRED EMBODIMENTS

The polyamide-imide used in the present invention can be produced by an isocyanate method in which at least one isocyanate component is polymerized with at least one acid anhydride component; or an acid chloride method in which at least one amine component is polymerized with at least one acid chloride or acid.

Examples of the isocyanate component used in the above-mentioned isocyanate method include 2,4-tolylene diisocyanate, 2,6-tolylene diisocyanate, diphenylmethane-4,4'-diisocyanate, 3,3'-diethyldiphenylmethane-4,4'-diisocyanate, 3,3'-dichlorodiphenylmethane-4,4'-diisocyanate, 3,3'-dichlorodiphenyl-4,4'-diisocyanate, 3,3'-dimethylbiphenyl-4,4'-diisocyanate, hexamethylene diisocyanate, isophorone diisocyanate, dicyclohexylmethane-4,4'-diisocyanate, p-phenylene diisocyanate, and m-phenylene diisocyanate.

As the acid anhydride component used in the above-mentioned isocyanate method, diesters of alkylene glycol and trimellitic acid 1,3-anhydride (i.e., alkylene glycol dianhydrotrimellitate) are used in an amount of 60 mol % or less, preferably 40 mol % or less. Examples of the diester include ethylene glycol dianhydrotrimellitate, propylene glycol dianhydrotrimellitate, 1,4-butanediol dianhydrotrimellitate, hexamethylene glycol dianhydrotrimellitate, polyethylene glycol dianhydrotrimellitate, and polypropylene glycol dianhydrotrimellitate.

Preferably, at least one selected from the group consisting of 3,3',4,4'-diphenyltetracarboxylic dianhydride, 4,4'-oxydiphthalic dianhydride, pyromellitic dianhydride, 3,3',4,4'-benzotetracarboxylic anhydride, and trimellitic anhydride can be further contained in the acid anhydride component. The anhydride can be contained in an amount of preferably 20 mol % or more. The addition of the anhydride serves to further improve the heat-resistance and chemical resistance of the resultant polyamide-imide.

As the amine component used in the above-mentioned acid chloride method, diaminodiphenylmethane or analogs thereof can be used in an amount of 60 mol % or more, preferably 80 mol % or more. Examples of such compounds include o-chloro-p-phenylenediamine, p-phenylenediamine, m-phenylenediamine, 4,4'-diaminodiphenyl ether, 3,4'-diaminodiphenyl ether, 3,4'-diaminodiphenylmethane, 4,4'-diaminodiphenylsulfone, 3,4'-diaminodiphenylsulfone, 4,4'-diaminobenzophenone, 3,4'-diaminobenzophenone, 2,2'-bis(aminophenyl)propane, 2,4-tolylenediamine, 2,6-tolylenediamine, p-xylylenediamine, isophoronediamine, hexamethylenediamine, and 4,4'-diaminodicylclohexylmethane.

Preferably, o-tolidine can be further contained in the amine component. O-tolidine can be contained in an amount of preferably 5 to 90 mol %. The addition of o-tolidine serves to further improve the solubility, heat resistance, and chemical resistance of the resultant polyamide-imide.

Examples of the acid chloride or acid (acid component) include terephthalic acid, isophthalic acid, 4,4'-biphenyl dicarboxylic acid, 4,4'-biphenyl ether dicarboxylic acid, 4,4'-biphenyl sulfone dicarboxylic acid, 4,4'-benzophenonedicarboxylic acid, pyromellitic acid, 3,3',4,4'-benzophenonetetracarboxylic acid, 3,3',4,4'-biphenylsulfonetetracarboxylic acid, 3,3',4,4'-biphenyltetracarboxylic acid, adipic acid, sebacic acid, maleic acid, fumaric acid, dimer acid, stilbenzylcarboxylic acid, and acid chlorides thereof. Furthermore, monochlorides of the acid anhydride component used in the isocyanate method can also be used.

In order to prepare the polyamide-imide by the isocyanate method, the isocyanate component is allowed to react with the acid anhydride component in a solution of N-methylpyrrolidone, dimethylacetamide, etc. at a temperature preferably from 50° to 200° C., more preferably from 80° to 180° C. In order to prepare the polyamide-imide by the acid chloride method, the amine component is allowed to react with the acid chloride or acid component in a solution of N-methylpyrrolidone, dimethylacetoamide, etc. at a temperature preferably from −50° to 200° C., more preferably from −50° to 100° C. In these methods, the identity of each component used is appropriately selected depending upon the physical properties desired of the resultant polyamide-imide.

The reaction can be effected in the presence of a catalyst to the reaction between isocyanate and an active hydrogen compound, e.g., tertiary amines, alkali metal compounds, alkaline earth metal compounds, or metal or semimetal compounds of such as cobalt, titanium, tin, and zinc. The reaction is usually effected at atmospheric pressure; however, it can be effected under pressure.

Furthermore, the polyamide-imide used in the present invention can be modified with an epoxy compound. Since the epoxy modified polyamide-imide contains epoxy groups, it can be cross-linked by drawing and heat treatment after spinning; and as a result, heat resistance and chemical resistance of the polyamide-imide can be enhanced and dripping can be suppressed when coming into contact with a flame. As the epoxy compound to be used for the modification, aromatic, aliphatic, or alicyclic epoxy compounds containing at least two functional groups can be used alone or in combination (at least two kinds thereof). In order to increase the cross-linking density of the polyamide-imide by adding a small amount of the epoxy compound to obtain fibers having outstanding heat resistance, flame resistance, and high strength, polyfunctional phenolic novolak type epoxy compounds are preferable. The content of the epoxy compound in the polyamide-imide is preferably 1 to 30% by weight, more preferably 2.5 to 20% by weight.

The logarithmic viscosity of the polyamide-imide or the epoxy-modified polyamide-imide of the present invention is preferably 0.5 to 2.5 dl/g, more preferably 0.9 to 2.0 dl/g when an N-methyl-2-pyrrolidone solution with a polymer concentration of 0.5 g/100 ml is measured at 25° C.

In order to enhance the characteristics as fibers and processability, various additives such as an oil material, an antistatic agent, a colorant, an antioxidant, and/or an inorganic filler can be appropriately added to the polyamide-imide or the epoxy-modified polyamide-imide of the present invention.

The polyamide-imide or the epoxy-modified polyamide-imide of the present invention can be fiberized by any fiberization method such as a dry spinning method and a wet spinning method using conventional facilities. Herein, the dry spinning method involves discharging a polymer solution into a heated gas and the solvent is removed from the solution whereby the solution is solidified and fiberized. The wet spinning method involves discharging a polymer solution into a coagulation bath and the solvent is removed from the solution whereby the solution is solidified and fiberized. In either the dry spinning method or the wet spinning method, as a solvent for dissolving the polyamide-imide, polar solvents such as N,N-dimethylformamide, N,N-dimethylacetamide, N-methyl-2-pyrrolidone, dimethylsulfoxide, and dimethyl urea are preferably used. The following solvents can be mixed with these polar solvents: hydrocarbon type solvents such as toluene and xylene; ketone type solvents such as acetone, methyl ethyl ketone, methyl isobutyl ketone, and cyclohexanone; ether type solvents such as dioxane, ethylene glycol dimethyl ether, and tetrahydrofuran; and ester type solvents such as ethyl acetate, acetic acid-n-butyl, and γ-butyrolactone.

In the case of fiberizing the polyamide-imide or the epoxy-modified polyamide-imide by the wet spinning method, water is the most preferable contained in the coagulation bath. Solvents which are nonsolvents for the above-mentioned polyamide-imide or the epoxy-modified polyamide-imide and which are compatible with the above-mentioned solvents can also be used.

The polyamide-imide fibers or the epoxy-modified polyamide-imide fibers of the present invention can be used in an undrawn state depending upon the desired use. However, in order to enhance the strength, heat resistance, and chemical resistance (especially, high temperature chemical resistance), it is preferred that the polyamide-imide fibers or the epoxy-modified polyamide-imide fibers are drawn and/or heat treated. When undergoing drawing and/or heat treatment, the polyamide-imide fibers or the epoxy-modified polyamide-imide fibers have a remarkably dense fiber structure, whereby the strength and elasticity of the fibers can be improved. When the fiber structure becomes dense, mist is prevented from boiling and evaporating in the fibers and on the surface of the fibers to damage the fiber structure. Furthermore, when the fibers are drawn and/or heat treated, the surface area of the fibers decreases, so that the fibers have a lower possibility of being degraded upon contact with chemicals. In the case where undrawn fibers contain no solvent, drawing conditions are as follows. The heating temperature during drawing is preferably 300° C. or more, more preferably 350° C. or more and a drawing ratio is preferably 1.5 or more, more preferably 3 or more. In the case where undrawn fibers contain a solvent, the drawing temperature can be decreased depending upon the content of the solvent.

Preferably, the polyamide-imide fibers or the epoxy-modified polyamide-imide fibers of the present invention have the following fiber physical properties: (A) the tensile break strength is preferably 3.0 g/d or more, more preferably 3.5 g/d or more; and (B) the tensile break elongation is preferably 10% or more, more preferably 15% or more.

According to the present invention, polyamide-imide having a specific amount (i.e., 60 mol % or more) of repeating units derived from a compound having a specific molecular structure (i.e., diaminodiphenylmethane and/or analogs thereof as the amine component; or alkylene glycol dianhydrotrimellitate as the acid component) can be obtained. Such a polyamide-imide has a flexible molecular structure due to the amine component or the acid component and has an appropriate solubility with respect to the solvent. Thus, the polyamide-imide is easily highly polymerized because of its flexible molecular structure, and therefore, exhibits sufficient elongation when fiberized, and is easily spun due to its appropriate solubility. As a result, the fibers obtained from the polyamide-imide can have very outstanding fiber physical properties such as high strength and high elasticity. Furthermore, the amine component or the acid component can contribute to heat resistance, flame resistance, and chemical resistance of the fibers to be obtained because of their molecular structures. Such polyamide-imide fibers can be effectively used for a high-temperature bag filter used in exhaust gas facilities.

EXAMPLES

Hereinafter, the present invention will be described by way of illustrative examples. It is noted that the present invention is not limited to these examples.

In the following examples, the characteristics of the polyamide-imide fibers obtained were measured by the following methods.

1. Logarithmic viscosity: measured at 25° C. by using 0.5 g of polymer dissolved in 100 ml of N-methyl-2-pyrollidone.

2. Tensile break strength and elongation: measured by TENSILON (manufactured by Toyo Boldwin) in an atmosphere of 55% RH under the following conditions: a temperature of 20° C., a tensile speed of 20 mm/min., and a chuck interval of 30 mm.

3. Flame resistance (LOI): measured in accordance with the method described in JIS-K7201.

4. High temperature chemical resistance test: single yarn was allowed to sink in a solution containing a chemical to be tested in a predetermined concentration or in a solvent to be tested. The yarn was taken up onto a glass bobbin end the bobbin was placed in a bottle made of polytetrafluoroethylene with a lid. The bottle was sealed with the lid and then, allowed to stand in a drying oven kept at 200° C. for two hours. The bobbin was cooled and taken out of the bottle, and the yarn was repeatedly washed with water and dried. Then, the yarn was subjected to a tensile strength and elongation test, and the high temperature chemical resistance of the yarn was evaluated based on the retention ratio of each physical property with respect to each property of untreated yarn.

Example 1

First, 325.65 g of trimellitic anhydride, 424.20 g of diphenylmethane-4,4'-diisocyanate, and 1400 g of N-methyl-2-pyrrolidone were charged into a reactor. The mixture was heated to 200° C. over about 1.5 hours while stirring. Then, while stirring, the mixture was kept at 200° C. for about 5 hours so as to obtain a polymer. The logarithmic viscosity of the polymer thus obtained was 0.95. The polymer solution was extruded through a one-hole nozzle and was passed through a dry spinning apparatus equipped with a furnace having a length of 1.5 m and a temperature of 270° C. at 220 m/minute to obtain undrawn fibers of 15.3 deniers (d). The undrawn fibers were thoroughly dried in vacuo so as to allow the remaining solvent to be about 1% or less. The fibers were passed through a heating zone (1 m) at 350° C. in a nitrogen atmosphere at a speed of 29 m/minute, whereby the fibers were drawn at a drawing ratio of 5. The tensile break strength of the drawn fibers (about 3 d) was 4.6 g/d, tensile elasticity 53.1 g/d, tensile break elongation 17.0%, a glass transition temperature 300° C., and a LOI value 31. The high temperature chemical resistance of the fibers thus obtained was tested with respect to chemicals and solvents shown in Table 1. Commercially available polyimide fibers (P-84, manufactured by Lenzing Co., Ltd.) were subjected to the same test. The results are shown in Table 1. In Table 1, "unmeasurable" refers to "remarkably swelled or degraded".

TABLE 1

| | Example 1 | | Commercially available polyimide | |
|---|---|---|---|---|
| | Strength (g/d) (Retention ratio %) | Elongation (g/d) (Retention ratio %) | Strength (g/d) (Retention ratio %) | Elongation (g/d) (Retention ratio %) |
| Blank | 4.6 | 17.0 | 3.7 | 22.4 |
| 7% sulfuric acid | 3.3 (72.3) | 11.1 (65.3) | 2.6 (71.3) | 13.5 (60.2) |
| 37% hydrochloric acid | 4.2 (93.1) | 15.7 (92.4) | 3.1 (83.7) | 20.3 (90.6) |
| 10% nitric acid | 3.6 (78.3) | 14.8 (87.1) | 1.7 (45.9) | 6.0 (26.8) |
| 50% chromic acid | 3.7 (80.4) | 14.8 (87.1) | unmeasurable | unmeasurable |
| Toluene | 4.3 (93.5) | 18.3 (107.6) | 3.9 (105.4) | 26.9 (117.9) |
| Phenol | 3.7 (80.4) | 17.3 (101.8) | 0 (dissolved) | 0 (dissolved) |
| Carbon tetrachloride | 4.2 (91.3) | 18.6 (109.4) | 3.4 (91.9) | 24.5 (109.1) |

Examples 2–5

Drawn fibers were prepared in the same way as in Example 1 except that the heating and elongation conditions of undrawn fibers were altered as shown in Table 2. The results are shown in Table 2. In Table 2, ◎ represents no change in high temperature chemical resistance; ○ slightly swelled; Δ swelled; and x dissolved or remarkably degraded (the same symbols will be used in Tables 3 to 6).

TABLE 2

| | Example 2 | Example 3 | Example 4 | Example 5 |
|---|---|---|---|---|
| Drawing temperature (°C.) | 350 | 320 | 350 | 350 |
| Drawing ratio | 4 | 4 | 5 | 6 |
| Break strength (g/d) | 3.0 | 5.0 | 4.9 | 4.0 |
| Break elongation (%) | 16.9 | 15.4 | 16.5 | 14.0 |
| High temperature chemial resistance: 7% sulfuric acid | ○ | ◎ | ◎ | ◎ |

Example 6

First, 215.2 g of trimellitic anhydride, 224.20 g of diphenylmethane-4,4'-diisocyanate, 59.2 g of 4,4'-diisocyanate-3,3'-dimethylbiphenyl, and 933.3 g of N-methyl-2-pyrrolidone were charged into a reactor. The mixture was allowed to react at 100° C. for about 3 hours while stirring. Then, 266.67 g of N-methyl-2-pyrrolidone was added to the mixture, and while stirring, the resultant mixture was kept at 200° C. for about 4 hours so as to obtain a polymer. The logarithmic viscosity of the polymer thus obtained was 1.15. The polymer solution was extruded through a one-hole nozzle and was passed through a dry spinning apparatus equipped with a furnace having a length of 1.5 m and a temperature of 290° C. at 200 m/minute to obtain undrawn fibers of 12.8 d. The undrawn fibers were dried and passed through a heating zone (1 m) at 350° C. in a nitrogen atmosphere at a speed of 20 m/minute, whereby the fibers were drawn at a drawing ratio of 5. The tensile break strength of the drawn fibers (about 2.4 d) was 5.9 g/d, tensile elasticity 62.8 g/d, tensile break elongation 18.1%, a glass transition temperature 297° C., and a LOI value 32.

Examples 7–10

Drawn fibers were prepared in the same way as in Example 6 except that the heating and elongation conditions of undrawn fibers were altered as shown in Table 3. The results are shown in Table 3.

TABLE 3

| | Example 6 | Example 7 | Example 8 | Example 9 | Example 10 |
|---|---|---|---|---|---|
| Drawing temperature (°C.) | 350 | 350 | 350 | 320 | 320 |
| Drawing ratio | 5 | 4 | 3 | 4 | 3 |
| Break strength (g/d) | 5.9 | 5.2 | 4.1 | 4.0 | 3.7 |
| Break elongation (%) | 18.1 | 23.1 | 24.7 | 25.4 | 26.8 |
| High temperature chemial resistance: 7% sulfuric acid | — | ⊙ | ○ | ○ | ○ |

Comparative Example 1

First, 318.94 g of trimellitic anhydride, 207.71 g of diphenylmethane-4,4'-diisocyanate, 219.35 g of 4,4'-diisocyanate-3,3'-dimethylbiphenyl, and 1400 g of N-methyl-2-pyrollidone were charged into a reactor. The mixture was allowed to react at 100° C. for about 3 hours while stirring. Then, 400 g of N-methyl-2-pyrrolidone was added to the mixture, and while stirring, the resultant mixture was kept at 200° C. for about 3.5 hours so as to obtain a polymer. The logarithmic viscosity of the polymer thus obtained was 1.32. The polymer solution was extruded through a one-hole nozzle and was passed through a dry spinning apparatus equipped with a furnace having a length of 1.5 m and a temperature of 290° C. at 200 m/minute to obtain undrawn fibers of 12.8 d. The undrawn fibers were dried and passed through a heating zone (1 m) at 360° C. in a nitrogen atmosphere at a speed of 29 m/minute, whereby the fibers were drawn at a drawing ratio of 3.5. The physical properties obtained are shown in Table 4.

Comparative Example 2

Drawn fibers were prepared in the same way as in Comparative Example 1 except that the drawing ratio was 3. The results ere shown in Table 4.

Comparative Examples 3

First, 315.09 g of trimellitic anhydride, 82.08 g of diphenylmethane-4,4'-diisocyanate, 346.74 g of 4,4'-diisocyanate-3,3'-dimethylbiphenyl, and 1400 g of N-methyl-2-pyrollidone were charged into a reactor. The mixture was allowed to react at 100° C. for about 3 hours while stirring. Then, 400 g of N-methyl-2-pyrrolidone was added to the mixture, and while stirring, the resultant mixture was kept at 200° C. for about 4 hours so as to obtain a polymer. The logarithmic viscosity of the polymer thus obtained was 1.41. The polymer solution was extruded through a one-hole nozzle and was passed through a dry spinning apparatus equipped with a furnace having a length of 1.5 m and a temperature of 290° C. at 200 m/minute to obtain undrawn fibers of 12.8 d. The undrawn fibers were dried and passed through a heating zone (1 m) at 380° C. in a nitrogen atmosphere at a speed of 29 m/minute, whereby the fibers were drawn at a drawing ratio of 3.5. The physical properties obtained are shown in Table 4.

Comparative Example 4

Drawn fibers were prepared in the same way as in Comparative Example 1 except that the drawing ratio was 2. The results are shown in Table 4.

TABLE 4

| | Comparative Example 1 | Comparative Example 2 | Comparative Example 3 | Comparative Example 4 |
|---|---|---|---|---|
| Drawing temperature (°C.) | 360 | 360 | 380 | 380 |
| Drawing ratio | 3.5 | 3 | 3 | 2 |
| Break strength (g/d) | 2.9 | 2.7 | 14.2 | 13.2 |
| Break elongation (%) | 12.1 | 16.3 | 5. 3 | 7.1 |
| High temperature chemial resistance: 7% sulfuric acid | Δ | Δ | x | x |

Example 11

First, 182.18 g of trimellitic anhydride, 196.55 g of diphenylmethane-4,4'-diisocyanate, 76.35 g of benzophenonetetracarboxylic dianhydride, and 1050 g of N-methyl-2-pyrrolidone were charged into a reactor. The mixture was heated to 200° C. over about 1.5 hours. Then, while stirring, the mixture was kept at 200° C. for about 5 hours so as to obtain a polymer. The logarithmic viscosity of the polymer thus obtained was 1.32. The polymer solution was extruded through a one-hole nozzle and was passed through a dry spinning apparatus equipped with a furnace having a length of 1.5 m and a temperature of 270° C. at 220 m/minute to obtain undrawn fibers of 15.5 d. The undrawn fibers were thoroughly dried in vacuo and passed through a heating zone (1 m) at 350° C. in a nitrogen atmosphere at a speed of 18 m/minute, whereby the fibers were drawn at a drawing ratio of 4.5. The tensile break strength of the drawn fibers (about 2.8 d) was 5.1 g/d, tensile elasticity 60.0 g/d, tensile break elongation 20.3%, a glass transition temperature 294° C., and a LOI value 32.

Examples 12–15

Drawn fibers were prepared in the same way as in Example 11 except that the heating and elongation conditions of undrawn fibers were altered as shown in Table 5. The results are shown in Table 5.

TABLE 5

| | Example 11 | Example 12 | Example 13 | Example 14 | Example 15 |
|---|---|---|---|---|---|
| Drawing temperature (°C.) | 350 | 350 | 350 | 320 | 320 |
| Drawing | 4.5 | 4 | 3 | 4 | 3 |

TABLE 5-continued

| | Example 11 | Example 12 | Example 13 | Example 14 | Example 15 |
|---|---|---|---|---|---|
| ratio | | | | | |
| Break strength (g/d) | 5.1 | 4.9 | 4. 7 | 4.2 | 3.5 |
| Break elongation (%) | 20.3 | 24.1 | 26.3 | 27.2 | 29.1 |
| High temperature chemial resistance: 7% sulfuric acid | — | ○ | ○ | ○ | ○ |

Comparative Example 5

First, 137.37 g of trimellitic anhydride, 357.85 g of diphenylmethane-4,4'-diisocyanate, 230.39 g of benzophenonetetracarboxylic dianhydride, and 1400 g of N-methyl-2-pyrrolidone were charged into a reactor. The mixture was allowed to react at 100° C. for about 3.5 hours. Then, 400 g of N-methyl-2-pyrollidone was added to the mixture, and while stirring, the mixture was kept at 200° C. for about 5 hours so as to obtain a polymer. The logarithmic viscosity of the polymer thus obtained was 1.22. The polymer solution was extruded through a one-hole nozzle and was passed through a dry spinning apparatus equipped with a furnace having a length of 1.5 m and a temperature of 270° C. at 220 m/minute to obtain undrawn fibers. The undrawn fibers were dried and passed through a heating zone (1 m) at 380° C. in a nitrogen atmosphere at a speed of 29 m/minute, whereby the fibers were drawn at a drawing ratio of 3.5. The physical properties obtained are shown in Table 6.

Comparative Example 6

Drawn fibers were prepared in the same way as in Comparative Example 5 except that the drawing ratio was 3. The results are shown in Table 6.

Comparative Example 7

First, 50.34 g of trimellitic anhydride, 327.82 g of diphenylmethane-4,4'-diisocyanate, 337.70 g of benzophenonetetracarboxylic dianhydride, and 1400 g of N-methyl-2-pyrrolidone were charged into a reactor. The mixture was allowed to react at 100° C. for about 3 hours. Then, 400 g of N-methyl-2-pyrrolidone was added to the mixture, and while stirring, the mixture was kept at 200° C. for about 3 hours so as to obtain a polymer. The logarithmic viscosity of the polymer thus obtained was 1.31. The polymer solution was extruded through a one-hole nozzle and was passed through a dry spinning apparatus equipped with a furnace having a length of 1.5 m and a temperature of 270° C. at 213 m/minute to obtain undrawn fibers. The undrawn fibers were dried and passed through a heating zone (1 m) at 380° C. in a nitrogen atmosphere at a speed of 29 m/minute, whereby the fibers were drawn at a drawing ratio of 3. The physical properties obtained are shown in Table 6.

Comparative Example 8

Drawn fibers were prepared in the same way as in Comparative Example 7 except that the drawing ratio was 3. The results are shown in Table 6.

TABLE 6

| | Comparative Example 5 | Comparative Example 6 | Comparative Example 7 | Comparative Example 8 |
|---|---|---|---|---|
| Drawing temperature (°C.) | 360 | 360 | 380 | 380 |
| Drawing ratio | 3.5 | 3 | 3 | 2 |
| Break strength (g/d) | 7.9 | 6.7 | 18.8 | 15.2 |
| Break elongation (%) | 9.1 | 9.8 | 4.5 | 6.2 |
| High temperature chemial resistance: 7% sulfuric acid | Δ | x | x | x |

As is apparent from Tables 1 to 6, the polyamide-imide fibers of the present invention have outstanding high temperature chemical resistance, break strength, and break elongation.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. Polyamide-imide fibers for a filter comprising a polyamide-imide resin produced by reacting an isocyanate component and an acid anhydride component, said isocyanate component comprising 4,4'-diphenylmethane diisocyanate, wherein said 4,4'-diphenylmethane diisocyanate is present in an amount of at least 60 mol % of said isocyanate component, wherein said fibers have sulfuric acid resistance.

2. Polyamide-imide fibers for a filter according to claim 1, wherein the polyamide-imide resin or fiber is modified with an epoxy compound.

3. Polyamide-imide fibers for a filter according to claim 1, having the following fiber physical properties (A) and (B) in an undrawn state or as a result of being drawn and heated:

(A) tensile break strength is at least 3.0 g/d; and (B) tensile break elongation is at least 10%.

4. Polyamide-imide fibers for a filter according to claim 1, wherein said isocyanate component and said acid anhydride component are reacted in combination with o-toluidine.

5. Polyamide-imide fibers for a filter according to claim 4, wherein the polyamide-imide resin or fiber is modified with an epoxy compound.

6. Polyamide-imide fibers for a filter according to claim 4, having the following fiber physical properties (A) and (B) in an undrawn state or as a result of being drawn and heated:

(A) tensile break strength is at least 3.0 g/d; and (B) tensile break elongation is at least 10%.

7. Polyamide-imide fibers for a filter comprising a polyamide-imide resin produced by reacting an isocyanate component and an acid anhydride component, said acid anhydride component comprising at least two acid anhydrides, one of said acid anhydrides being an alkylene glycol dianhydrotrimellitate, said alkylene glycol dianhydrotrimellitate being present in an amount of up to 60 mol % of said acid anhydride component, wherein said fibers have sulfuric acid resistance.

8. Polyamide-imide fibers for a filter according to claim 7, wherein the polyamide-imide resin or fiber is modified with an epoxy compound.

9. Polyamide-imide fibers for a filter according to claim 7, having the following fiber physical properties (A) and (B) in an undrawn state or as a result of being drawn and heated:

(A) tensile break strength is at least 3.0 g/d; and (B) tensile break elongation is at least 10%.

10. Polyamide-imide fibers for a filter according to claim 7, wherein said acid anhydride component further comprises at least one acid anhydride selected from the group consisting of benzophenonetetracarboxylic dianhydride, 3,3',4,4'-diphenyltetracarboxylic dianhydride, and pyromellitic dianhydride.

11. Polyamide-imide fibers for a filter according to claim 10, wherein the polyamide-imide resin or fiber is modified with an epoxy compound.

12. Polyamide-imide fibers for a filter according to claim 10, having the following fiber physical properties (A) and (B) in an undrawn state or as a result of being drawn and heated:

(A) tensile break strength is at least 3.0 g/d; and (B) tensile break elongation is at least 10%.

13. Polyamide-imide fibers for a filter according to claim 7, wherein the other of said two acid anhydrides is selected from the group consisting of benzophenonetetracarboxylic dianhydride, 3,3',4,4'-diphenyltetracarboxylic dianhydride, and pyromellitic dianhydride.

* * * * *